US005928604A

United States Patent [19]

Keil et al.

[11] Patent Number: 5,928,604

[45] Date of Patent: Jul. 27, 1999

[54] AUTOMATED SYSTEM FOR CARBURIZING A COMPONENT

[75] Inventors: Gary D. Keil, Elmwood, Ill.; Fredric A. Woldow, York, Pa.

[73] Assignee: Caterpillar Inc., Peoria, Ill.

[21] Appl. No.: 09/106,412

[22] Filed: Jun. 29, 1998

Related U.S. Application Data

[62] Division of application No. 08/757,419, Nov. 27, 1996, abandoned.

[51] Int. Cl.[6] ..... C21D 1/62

[52] U.S. Cl. ..... 266/259; 266/252

[58] Field of Search ..... 266/249, 252, 266/259

[56] References Cited

U.S. PATENT DOCUMENTS 4,373,973 2/1983 Cellitti et al. ..... 148/12.4
4,763,880 8/1988 Smith et al. ..... 266/87
5,143,558 9/1992 Smith ..... 266/252
5,656,106 8/1997 Amateau et al. ..... 148/586

FOREIGN PATENT DOCUMENTS 133-959A1 3/1985 European Pat. Off. .

*Primary Examiner*—Scott Kastler
*Attorney, Agent, or Firm*—Larry G. Cain

[57] ABSTRACT

The present automated system for carburizing a component decreases the energy used to manufacture the component. The operations of heating the component in a first heating apparatus, forging the component in a forge and transferring the hot forged component directly to a second heating apparatus having a controlled atmosphere, increasing the temperature of the component, absorbing carbon within the component to a predetermined surface carbon content and depth and directly transferring the component to a quenching chamber and quenching the component defining a heat treated component.

9 Claims, 1 Drawing Sheet

62
66
56
50
52
68
70
54
44
48
60
58
46
42
64
40
28
10
24
22
26
72
20
16
18
14
8

AUTOMATED SYSTEM FOR CARBURIZING A COMPONENT

This is a divisional application of application Ser. No. 08/757,419, filed Nov. 27, 1996 now abandoned.

TECHNICAL FIELD

This invention relates generally to a continuous system for manufacturing and heat treating a components and more particularly to the process of forging, carburizing, machining if necessary and heat treating.

BACKGROUND ART

Traditionally, carburized gears and other components made from steel forgings are manufactured in separate manufacturing operations consisting of forging, cooling, cleaning, machining, carburizing and hardening. Forging and warm forming technology has improved over the past few years. It is now possible to produce near net shaped parts such as gears with the teeth accurately forged to finished or near finished size. Once formed, the parts are cooled and cleaned of scale. The parts are then subjected to an independent carburizing operation followed either by direct hardening or cooling and subsequent reheat hardening operation. These independent operations result in an inefficient use of energy in that many independent operations of heating and cooling occur. Further, the parts are normally heated in furnaces or by induction without protective atmospheres prior to forging or warm forming and then are allowed to air cool. These steps produce scale on the surface which must be removed prior to subsequent machining or carburizing operations which adds cost to the process.

Another problem associate with independent operations is the inefficient use of energy in that many operations require heating, cooling and reheating.

The present invention is directed to overcome one or more of the problems as set forth above.

DISCLOSURE OF THE INVENTION

In one aspect of the present invention, an automated system for carburizing a component is comprised of the following steps: a first heating apparatus having an inlet end through which the component enters the first heating apparatus and an outlet end through which the component exits the first heating apparatus; a forge having at least a first station being in communication with the outlet end of the first heating apparatus and receiving the component from the first heating apparatus and having a last station; a second heating apparatus having an inlet end being in communication with the last station of said forge and receiving said component, and the second heating apparatus further having a first outlet end and a second outlet end; a quenching chamber having an inlet end being in communication with the first outlet end of the second heating apparatus; a slow cooling chamber having an inlet end being in communication with the second outlet end of the second heating apparatus; and the component being communicated to one of the quenching chamber and the slow cooling chamber.

In another aspect of the invention a component being carburized by an automated system is comprised the following steps: the component being introduced through an inlet end of a first heating apparatus and exiting through an outlet end of the first heating apparatus after being heated to a preestablished temperature; the component being directed to a first station of a forge, being processed and exiting a last station having a near net configuration of the components defined; the component being directed to an inlet end of a second heating apparatus and exiting through an outlet end after being heated to a preestablished temperature and after absorbing a preestablished amount of carbon to a preestablished surface carbon content and depth of said component.

BEST MODE FOR CARRYING OUT THE INVENTION

Figure 1:
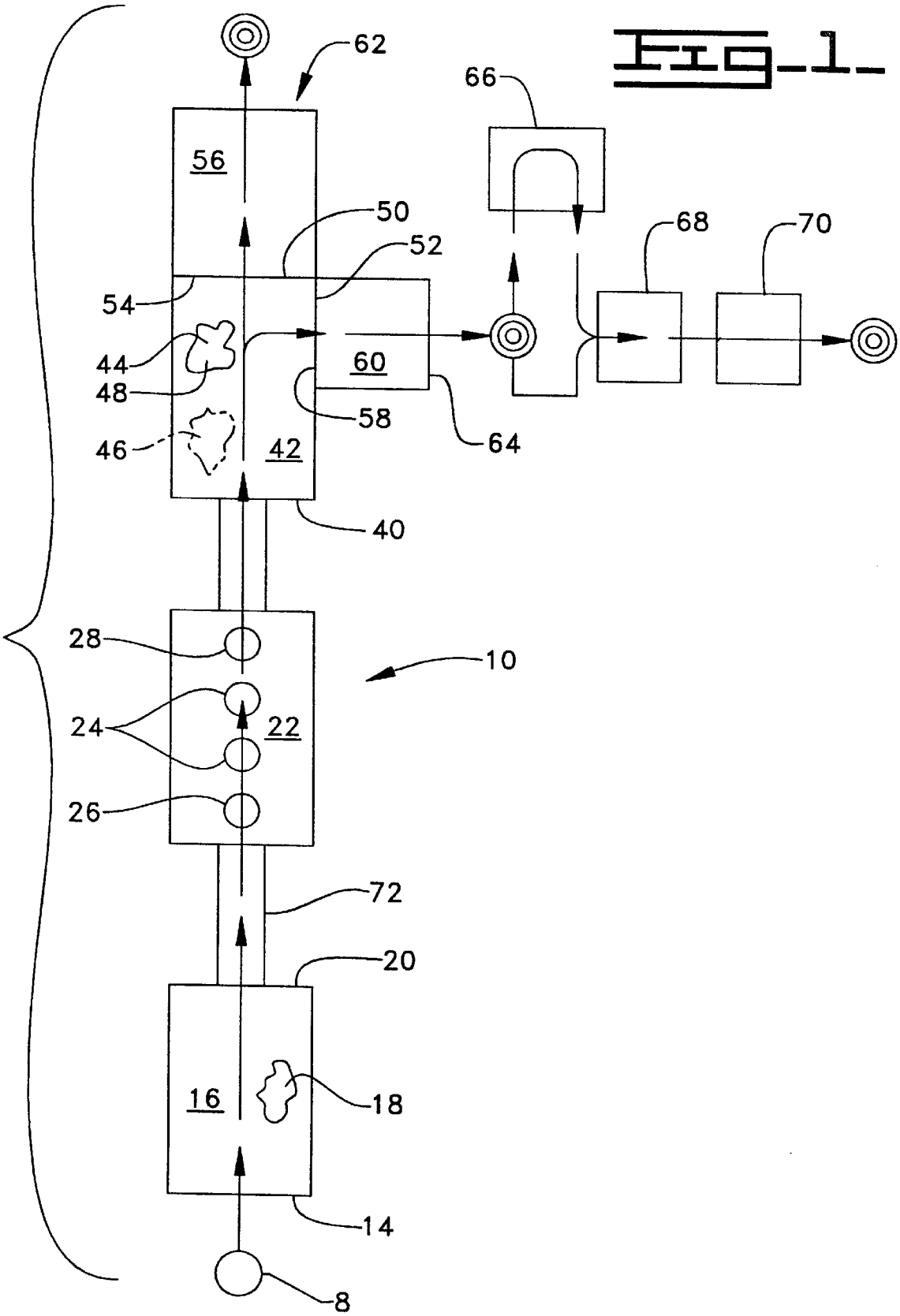
FIG. 1 is a diagrammatic plan view of a preferred embodiment of the present invention.

Referring to FIG. 1, an automated system 10 for manufacturing a component 12, such as a gear, is shown. A supply of gears 12 are readily available to the automated system 10. The components 12 are placed into an inlet end 14 of a first heating apparatus 16 such as a furnace arrangement, electrical resistance device or electrical induction device being of conventional construction. The first heating apparatus 16 is heated to a preestablished temperature and will have either a protective atmosphere 18 or it will be without a protective atmosphere. In operatively connected relationship with an outlet end 20 of the first heating apparatus 16 is a conventional forge press 22 having at least a single station but in many applications including a plurality of stations 24. As an alternative, the forge press 22 can be substituted with a warm forming process. Typically the forging process operates at a higher temperature than that of the warm forming process. Each of the plurality of station 24 from a first station 26 to a last station 28, which if using a single forge is the first station, form the gear 12 into a near net configuration. The gears 12 will be near net forged to a preestablished shape. Operatively connected to the forge press 22 is an inlet end 40 of a second heating apparatus 42, such as a furnace arrangement, electrical resistance device or electrical induction device being of conventional construction having a controlled atmosphere 44. The second heating apparatus 42 is heated to a preestablished temperature. The controlled atmosphere 44 will be set to either a non-scaling parameter 46 or a carburizing parameter 48. The component 12 absorbing a preestablished amount of carbon to a preestablished surface carbon content and depth of the component 12. The second heating apparatus 42 has a first outlet end 50 and a second outlet end 52. Operatively connected to the first outlet end 50 of the second heating apparatus 42 is an inlet end 54 of a quenching chamber 56 of conventional construction. Operatively connected to the second outlet end 52 of the second heating apparatus 42 is an inlet end 58 of a slow cooling chamber 60 being of conventional construction. The gear 12 in the near net configuration exits an outlet end 62 of the quenching chamber 56. Or, the gear 12 in the near net configuration exits an outlet end 64 of the slow cooling chamber 60 wherein the gear 12 will be finished machined in a machining center 66 prior to being reheated in an additional or third heating apparatus 68 and quenched in an additional quenching chamber 70 resulting is a heat treated component 12. As a further alternative, shown in FIG. 1, the gear 12 in the near net configuration exits the outlet end 64 of the slow cooling chamber 60 and moves directly to the third heating apparatus 68 to be reheated and quenched in the chamber 70 resulting in a heat treated component.

Interconnecting each of the first heating apparatus 16, the forge press 22, the second heating apparatus 42, the quench chamber 56 and the slow cooling chamber 60 is a conventional conveyer system 72. Or, as a further alternative, the component could be hand tonged between the first heating apparatus 16, the forge press 22, the second furnace 42, the quench chamber 56 and the slow cooling chamber 60 or any portion thereof.

INDUSTRIAL APPLICABILITY

In operation, a plurality of the component blanks 12 are loaded into the inlet end 14 of the first heating apparatus 16. In this application, the first heating apparatus 16 is void of a protective atmosphere 18 and the individual component blank 12 is heated to a preestablished temperature and exits the outlet end 20 on the conventional conveyer system 72 to the first station 26 of the forge press 22. Within the plurality of stations 24 the component blank 12 is forged into a near net configuration. The near net configuration of the component 12 exits the last station 28 and is transferred by the conventional conveyer system 72 to the inlet end 40 of the second heating apparatus 42. In this application, the controlled atmosphere 44 of the second heating apparatus 42 has a carburizing parameter 48. The direct transfer from the last forging station 28 into the second heating apparatus 42 minimizes the distortion from thermal cycling. Furthermore, the heat remaining from the forging operation is utilized for carburizing the component decreasing the heat energy required by the second heating apparatus 42. Within the second heating apparatus 42 the temperature of the near net component 12 is adjusted, the temperature could be increased or decreased, to a preestablished temperature within the controlled atmosphere 44 having the carburizing parameter 48 for a preestablished time for depth after which the component 12 can is transferred from the first outlet 50 by the conventional conveyer system 72 to the inlet end 54 of the quenching chamber 56. Within the quenching chamber 56 the desired heat treat or hardness characteristics of the component 12 is finalized.

As a first alternative, to the system 10 described above, the first heating apparatus 16 will have a protective atmosphere 18 and the remainder of the steps are as described.

As a second alternative, to the system 10 described above, the second heating apparatus 42 with the controlled atmosphere 44 has the non-scale parameter 46. And, the component 12 is transferred from the second outlet end 50 of the second heating apparatus 42 to the inlet end 58 of the slow cooling chamber 60. After slow cooling the component 12 exits the outlet end 64 to allow intermediate machining prior to being reheated and quenched forming the desired heat treat or hardness characteristics of the component 12.

As a further alternative, any combination of the system 10 with the first alternative, the second alternative and the original alternative can be utilized without changing the essence of the invention. Additionally, the system could include carburizing and the slow cooling exit.

Other aspects, objects and advantages of this invention can be obtained from a study of the drawings, the disclosure and the appended claims.

We claim:

1. An automated system for carburizing a component comprising the following steps:

a first heating apparatus having an inlet end through which said component enters the first heating apparatus and an outlet end through which said component exits the first heating apparatus;

a forge having at least a first station being in communication with said outlet end of said first heating apparatus and receiving said component from said first heating apparatus and having a last station;

a second heating apparatus having an inlet end being in communication with said last station of said forge and receiving said component, and said second heating apparatus further having a first outlet end and a second outlet end;

a quenching chamber having an inlet end being in communication with said first outlet end of said second heating apparatus;

a slow cooling chamber having an inlet end being in communication with said second outlet end of said second heating apparatus; and said component being communicated to one of said quenching chamber and said slow cooling chamber.

2. The automated system of claim 1 wherein said first heating apparatus includes a protective atmosphere positioned between the inlet end and outlet end of said first heating apparatus.

3. The automated system of claim 1 wherein said forge defines a plurality of stations forming said component into a near net configuration.

4. The automated system of claim 1 wherein said second heating apparatus defines a controlled atmosphere positioned between the inlet end and the first and second outlet end of said second heating apparatus, said controlled atmosphere being adapted for controlling scaling on said component.

5. The automated system of claim 1 wherein said second heating apparatus defines a controlled atmosphere positioned between the inlet end and the first and second outlet end of said second heating apparatus, said controlled atmosphere being adapted for controlling carburizing of said component.

6. The automated system of claim 1 wherein said quenching chamber includes an outlet end having a component exiting therefrom being of the near net configuration and having a preselected heat treatment.

7. The automated system of claim 1 wherein said slow cooling chamber includes an outlet end having a component exiting therefrom being of the near net configuration and needing additional machining.

8. The automated system of claim 1 wherein said first heating apparatus, said forge, said second heating apparatus and said quenching chamber are in communication with a conveyer system.

9. The automated system of claim 1 wherein said first heating apparatus, said forge, said second heating apparatus and said slow cooling chamber are in communication with a conveyer system.

* * * * *